US006691610B1

(12) United States Patent
Wilen

(10) Patent No.: US 6,691,610 B1
(45) Date of Patent: Feb. 17, 2004

(54) METHOD FOR PRINTING METALLIC INKS

(76) Inventor: Richad Wilen, 3333 SW. 15th St., Deefield Beach, FL (US) 33442

( * ) Notice: Subject to any disclaimer, the term of this patent is extended or adjusted under 35 U.S.C. 154(b) by 0 days.

(21) Appl. No.: 10/286,312

(22) Filed: Nov. 1, 2002

(51) Int. Cl.[7] ..... B41M 1/14

(52) U.S. Cl. ..... 101/211; 101/181; 101/491; 101/216; 427/258; 427/259

(58) Field of Search ..... 101/211, 490, 101/491, 216, 181, 171, 205, 206, 208, 210; 427/258, 259

(56) References Cited

U.S. PATENT DOCUMENTS 1,454,676 A 5/1923 Gillbee et al.
3,554,123 A * 1/1971 Lewallen ..... 101/211
3,751,282 A 8/1973 Massa
4,113,895 A 9/1978 Watt et al.
4,135,960 A * 1/1979 Shuppert et al. ..... 101/211
4,411,194 A * 10/1983 Davidson, Jr. ..... 101/216
4,774,885 A * 10/1988 Chmielnik ..... 101/211
5,370,976 A 12/1994 Williamson et al.
5,496,587 A 3/1996 Leung
5,598,777 A 2/1997 DeMoore et al.
5,630,363 A * 5/1997 Davis et al. ..... 101/181
5,638,752 A 6/1997 Hartung et al.
5,656,331 A 8/1997 Kline
5,733,634 A 3/1998 Karel
5,750,186 A * 5/1998 Frazzitta ..... 427/258
6,267,052 B1 * 7/2001 Hill et al. ..... 101/211

* cited by examiner

*Primary Examiner*—Eugene H. Eickholt
(74) *Attorney, Agent, or Firm*—Stephen E. Feldman

(57) ABSTRACT

There is disclosed a method for printing metallic inks wherein a fountain solution and a first imprint ink are concurrently deposited onto a printing plate. A foundation metallic ink is then deposited onto the first imprint ink followed by depositing a second imprint ink is then onto the metallic ink. One or more layers of process ink colors can then be deposited onto the second imprint ink. The fountain solution is adjusted to have a pH of from about 3.7 to about 3.9 and the metallic ink is provided to have a tack of from about 14 to about 16.

20 Claims, No Drawings

METHOD FOR PRINTING METALLIC INKS

FIELD OF THE INVENTION

This invention is directed toward a method for printing metallic inks. More particularly, this invention is directed toward a method for printing multiple colored metallic inks. Even more particularly, this invention is directed toward using a single metallic ink to produce any desired metallic ink or any desired combination of multiple colored metallic inks.

BACKGROUND OF THE INVENTION

Current methods employed to produce colored metallic ink printing typically require the creation of knockouts or traps to accommodate the metallic ink, setting up the paper and presses to receive the metallic inks and creating the knockouts or traps in pre-press to prepare them for the next printing operation. These are costly, time consuming and labor intensive operations. While many attempts have been made to overcome these problems and reduce operation costs, none have been completely satisfactory.

For example, U.S. Pat. No. 1,454,767 to Gillbee discloses a process for manufacturing commercial paper wherein a liquid bronze is applied to the surface of the paper. The paper is then dried and a color is applied over the dried paper.

U.S. Pat. No. 3,751,282 to Massa discloses a method for printing solid colored areas on a surface by combining layers of colored ink with a layer of finely divided white pigment.

U.S. Pat. No. 5,370,976 to Williamson, et.al. discloses a metallic color printing process wherein an image is screened to create four color separations of the screened image. Metallic gold and/or metallic silver color separation is achieved by electronically selecting the color area where an effect is desired.

U.S. Pat. No. 5,496,567 to Leung discloses a method for metallic coating a plastic sheet by applying two layers of ink. The first layer is applied by lithographic printing in a pattern that includes open spaces and contains a color that forms the base of the article. The second layer is a metallic color layer.

U.S. Pat. No. 5,598,777 to DeMoore, et.al. discloses a retractable printing/coating unit. A metallic powder is applied to a previously printed substrate to produce a grainy, textured finish.

U.S. Pat. No. 5,638,752 to Hartung, et.al. discloses a multicolor offset printing press for printing materials and coating them in-line. The printing press includes an in-line flexographic printing/lacquering unit for applying fluid coatings to materials printed by the printing press. The press is utilized to produce metallic luster coatings.

U.S. Pat. No. 5,656,331 to Kline discloses a method for printing a substrate having a metallic finish bypoating a printed substrate with three coats of ink. The first coating applied is a solid coating; the second coating applied is a moire pattern color, and, the third coating applied is a water pearl color.

U.S. Pat. No. 5,733,634 to Karel discloses a color printing process of an opaque substrate sheet. One side of the sheet has a reflective metallic appearance to which there is applied a first coating of white dots. A second coating of process colors is then applied over the first coating.

These illustrative metallic printing approaches are costly, time consuming and labor intensive requiring the use of specialized or expensive machinery and do not readily permit the printing of multi-colored metallic inks.

SUMMERY OF THE INVENTION

It has now been found that the shortcomings of these typical metallic ink printing approaches have been overcome by the method of the present invention. In general, the method of the present invention comprises: transferring a fountain solution onto a printing substrate; concurrently transferring a first imprint ink onto said printing substrate; transferring a foundation metallic ink onto said first imprint ink; transferring a second imprint ink onto said foundation metallic ink; and, transferring one or more process ink colors onto said second imprint ink.

In one embodiment, the pH of the fountain solution is adjusted to be from about 3.7 to about 3.9.

In another embodiment, although the first foundation ink can be of any color, it is preferably black.

In a further embodiment, the foundation metallic ink is a reformulated silver metallic ink although other metallic ink colors can also be employed. In addition, the silver metallic ink is formulated with a sufficient amount of drying agent to impart a tack to it of from about 14 to about 16.

In still another embodiment, the second imprint ink is preferably black, although other ink colors can be used In yet another embodiment, the process color inks employed are those selected from the group consisting of blue, red and yellow. By appropriate mixing of these process colors, other colors, hues and tints can be attained. For example, proper mixing of blue and red process colors can provide violet and magenta hues. Similarly, proper mixing of blue and yellow process colors can afford green and aqua tints. Also, proper mixing of process colors red and yellow can yield orange and gold colors. These mixing techniques and the colors, tints and hues that can be obtained are all within the expertise of the skilled artisan in this field.

By utilizing the method of the invention, the metallic prints obtained do not have to be varnished and they will not chalk or become marked. In addition, only the separations on the foundation silver metallic ink need to be knocked out as the color process inks are printed over the foundation silver metallic ink; i.e., trapped on top of it. Consequently, the only registration required for full coverage is block registration.

Thus, the method of the invention enables a single, reformulated metallic ink to be used to create any desired or required multicolored metallic ink pattern. As a result, the process color metallic inks can be printed as desired or required ranging from tints to solids to screen built colors. By using the simple block registration afforded by the method of the invention, one can create excellent registration qualities in full metallic ink coverage resulting in less paper waste, faster "make readies" and the ability to print exclusively on 28–32 pound coated paper.

Utilizing the method of the invention enables one to properly control ink flow and water balance. In addition, the method of the invention enables one to control process colors such as separation and art without contaminating the process colors which can be selected from a full coverage range of metallic inks. Since most metallic inks are run either first down or last down, the method of the invention also facilitates release of the inks from blankets and permits control of tension and registration.

As used throughout this application and in the appended claims, the following terms and expressions have the stated meanings:

| | |
|---|---|
| Blankets- | in offset lithography, this denotes a rubber-surfaced sheet that is clamped around a cylinder and that transfers an image from a plate to paper. |
| Block- | denotes simple printing registration |
| Block Register- | denotes the fitting of two or more printing images upon the same sheet of paper in exact alignment with one another. |
| Fountain | |
| Solution- | denotes a commercially obtained solution that is added to tap water and that aids the printing process by preventing applied ink(s) from sticking to printing substrates |
| Knockouts- | denote openings in an image created in the preparation process that enables another image to be printed in that place such as a solid color having an opening within it and another image placed in that opening. |
| PMS- | denotes the "Pantone Measuring System"; a book comprised of hundreds of colors and the formulas used to create them. |
| Putting Down- | denotes applying an ink to a printing substrate such as a printing roller, a printing plate, and the like. |
| Solid- | denotes 100% of a color |
| Screens- | denote a percentage of a color, usually 5–95% |
| Screen Built | |
| Colors- | denote colors that are made up of different percentages of screened colors |
| Traps- | denote the printing of a color on paper; as the paper is run to next printing unit, another color is printed onto the first color. |

It should also be understood that, unless otherwise indicated, all ingredients and components used throughout the application and set forth in the appended claims are standard, commercially available products used by and supplied to the printing industry. For example, all inks used in the present invention; i.e., the imprint inks and the process inks, can be commercially obtained from Kohl & Madden, Ft. Lee, N.J.

DETAILED DESCRIPTION OF THE INVENTION

Typical, commercially available fountain solutions can be obtained from Press Room Solutions, Inc., Ft. Worth, Tex. These commercially provided fountain solutions are mixtures of chemicals and water that are typically used to aid the printing process and generally have a pH that falls in the range of from about 4.5 to about 5.0 which is standard for the industry.

In practicing the method of the invention, it is important that the pH of the fountain solution be adjusted to and maintained at from about 3.7 to about 3.9 by using a dilute solution of an appropriate commercial acid such as hydrochloric acid. If this pH is permitted to rise above about 3.9 or fall below about 3.7, the metallic ink will not set properly, overprints will not trap properly and underprints will halo.

The fountain solution is then placed in one or more water trays depending upon the number of different colors to be printed. For example, if four colors are to be printed, the fountain solution is placed in four, separate water trays, one for each color to be printed. A printing roller is then used to pick up fountain solution from each tray and transfer the fountain solution onto a printing substrate such as a printing plate.

Similarly, the first imprint ink is also placed in one or more trays, a separate tray being used for each color to be printed. As the fountain solution is being transferred onto the printing substrate, printing rollers pick up the first imprint ink and concurrently transfer the first imprint ink onto the same printing substrate.

Next, the foundation metallic ink, which has been adjusted by the supplier to have a tack of from about 14 to about 16, is transferred by use of printing rollers onto the first imprint ink.

Following this, a second imprint ink is transferred by printing rollers onto the foundation metallic ink.

Using printing rollers, the process ink colors are then transferred onto the second imprint ink and the printing substrate is now ready to print.

Printing of the process colors onto a printing stock such as paper is accomplished by known methods that typically includes a plate pressurized by a blanket to from about 80 to about 100 psi. which transfers the image from the printing substrate onto the printing stock.

In an alternative approach, the process colors can be transferred onto the foundation metallic ink prior to transferring the second imprint ink.

The method of the invention is further illustrated by the following example.

EXAMPLE

A printing order requiring printing output in metallic blue, green, gold and yellow can be set up by placing a fountain solution whose pH has been adjusted to be maintained at from about 3.7 to about 3.9 into four separate trays. A sufficient amount of a black first imprint ink can also be placed into four separate trays. Utilizing print rollers, the fountain solution and the first imprint ink can be concurrently transferred onto a printing substrate.

Using printing rollers, a reformulated silver metallic ink having a tack of from about 14 to about 16 can then be transferred onto the first imprint ink after which a black second imprint ink can be transferred by printing rollers onto the silver metallic ink.

Using separate printing rollers for each color, the four process colors of blue, green, gold and yellow can then be sequentially deposited onto pre-selected portions of the printing substrate. The printing substrate can then be pressurized by a printing blanket to transfer the image from the printing substrate onto the sleeted paper stock resulting in a printed product having metallic ink colors that match the PMS standard.

Although the method of the invention has been describe with particularity and in some detail, it will be appreciated by those skilled in this art that changes and modifications can be made therein without departing from the scope and spirit of the invention.

What is claimed:

1. A method for printing metallic inks comprising:

(a) transferring a fountain solution onto a printing substrate;

(b) concurrently transferring a first imprint ink onto said printing substrate;

(c) transferring a foundation metallic ink onto said first imprint ink;

(d) transferring a second imprint ink onto said foundation metallic ink;

and, (e) transferring one or more process ink colors onto said second imprint ink.

2. The method of claim 1 wherein said fountain solution has a pH of from about 3.7 to about 3.9.

3. The method of claim 1 wherein said first imprint ink is black.

4. The method of claim 1 wherein said foundation metallic ink is a reformulated metallic silver ink.

5. The method of claim 4 wherein said metallic silver ink has a tack of from about 14 to about 16.

6. The method of claim 1 wherein said second imprint ink is black.

7. The method of claim 1 wherein said process inks are members selected from the group consisting of blue, red, yellow and mixtures and combinations thereof.

8. The method of claim 1 wherein one or more of said process inks is optionally transferred onto said foundation metallic ink before said second imprint ink is transferred.

9. A method for printing metallic inks comprising:

(a) adjusting the pH of a fountain solution to be from about 3.7 to about 3.9;

(b) transferring said fountain solution onto a printing substrate;

(c) concurrently transferring a first black imprint ink onto said printing substrate;

(d) transferring a reformulated foundation metallic silver ink onto said first imprint ink;

(e) transferring a second black imprint ink onto said metallic silver foundation ink; and, (f) transferring one or more process ink colors onto said second imprint ink.

10. The method of claim 9 wherein said foundation metallic silver ink has a tack of from about 14 to about 16.

11. The method of claim 9 wherein said process inks are members selected from the group consisting of blue, red, yellow and mixtures and combinations thereof.

12. The method of claim 9 wherein one or more of said process inks is optionally transferred onto said metallic silver foundation ink before said second imprint ink is transferred.

13. A method for printing metallic inks comprising:

(a) adjusting the pH of a fountain solution to be from about 3.7 to about 3.9;

(b) transferring said fountain solution onto a printing substrate;

(c) concurrently transferring a first black imprint ink onto said printing substrate;

(d) adjusting the tack of a reformulated foundation metallic silver ink to be from about 14 to about 16;

(e) transferring said foundation metallic silver ink onto said first imprint ink;

(f) transferring a second black imprint ink onto said foundation metallic silver ink; and, (g) transferring one or more process ink colors onto said second imprint ink, said process ink colors being members selected from the group consisting of blue, red, yellow and mixtures and combinations thereof.

14. The method of claim 13 wherein one or more of said process ink colors is optionally transferred onto said metallic silver foundation ink before said second imprint ink is transferred.

15. A metallic printing ink composite sequentially comprising:

(a) a first imprint ink layer;

(b) a foundation metallic ink layer on said first imprint ink layer;

(c) a second imprint ink layer on said foundation metallic ink layer; and, (d) a layer of one or more process ink colors on said second imprint ink layer.

16. The composite of claim 15 wherein said first imprint ink is black.

17. The composite of claim 15 wherein said foundation metallic ink is a reformulated metallic silver ink.

18. The composite of claim 17 wherein said foundation metallic ink has a tack of from about 14 to about 16.

19. The composite of claim 15 wherein said second imprint ink is black.

20. The composite of claim 15 wherein said process ink colors are members selected from the group consisting of blue, red, yellow and mixtures and combinations thereof.

* * * * *